US010902809B2

(12) United States Patent
Shi et al.

(10) Patent No.: US 10,902,809 B2
(45) Date of Patent: Jan. 26, 2021

(54) SCAN DRIVER CIRCUIT, ARRAY SUBSTRATE AND DISPLAY PANEL

(71) Applicant: Shenzhen China Star Optoelectronics Semiconductor Display Technology Co., Ltd., Guangdong (CN)

(72) Inventors: Longqiang Shi, Guangdong (CN); Shu Jhih Chen, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 198 days.

(21) Appl. No.: 16/303,624

(22) PCT Filed: Jan. 19, 2018

(86) PCT No.: PCT/CN2018/073502
§ 371 (c)(1),
(2) Date: Nov. 20, 2018

(87) PCT Pub. No.: WO2019/033709
PCT Pub. Date: Feb. 21, 2019

(65) Prior Publication Data

US 2020/0320946 A1 Oct. 8, 2020

(30) Foreign Application Priority Data

Aug. 16, 2017 (CN) ..... 2017 1 0702249

(51) Int. Cl.
*G09G 3/36* (2006.01)
*G09G 3/3208* (2016.01)

(52) U.S. Cl.
CPC ..... *G09G 3/3674* (2013.01); *G09G 3/3208* (2013.01)

(58) Field of Classification Search
CPC .. G09G 3/3674; G09G 3/3677; G09G 3/3266; H01L 27/1255; G02F 1/1368
See application file for complete search history.

(56) References Cited

U.S. PATENT DOCUMENTS 9,977,292 B2 * 5/2018 Jung ..... G02F 1/13394
2013/0039455 A1 * 2/2013 Horiuchi ..... G11C 19/28 377/54
2015/0138466 A1 * 5/2015 Mori ..... G11C 19/28 349/38

FOREIGN PATENT DOCUMENTS

CN 101978504 A 2/2011
CN 101978505 A 2/2011
(Continued)

OTHER PUBLICATIONS

CN2017107022490—1st Office Action.

*Primary Examiner* — Sardis F Azongha
(74) *Attorney, Agent, or Firm* — Leong C. Lei

(57) ABSTRACT

A scan driver circuit includes a pull-up unit and a bootstrap unit arranged on a base. The pull-up unit includes a pull-up thin-film transistor for supplying a scan drive signal. The bootstrap unit includes a bootstrap capacitor electrically connected with the pull-up thin-film transistor. The pull-up thin-film transistor includes a gate electrode, a first insulation layer, and a source electrode and a drain electrode stacked in sequence from the base. The bootstrap capacitor includes first and conductive electrodes. The first conductive electrode and the source electrode are arranged on the same layer and are electrically connected together. A second insulation layer is arranged between the second conductive electrode and the second electrode. The second conductive electrode is electrically connected, through a first via that extends through the second insulation layer and the first
(Continued)

insulation layer, to the gate electrode. An array substrate and a display device are also provided.

7 Claims, 9 Drawing Sheets

(56) References Cited

FOREIGN PATENT DOCUMENTS

| | | | |
|---|---|---|---|
| CN | 104536223 | A | 4/2015 |
| CN | 204406964 | U | 6/2015 |
| CN | 106200167 | A | 12/2016 |
| JP | 2017-120434 | A | 7/2017 |

* cited by examiner

SCAN DRIVER CIRCUIT, ARRAY SUBSTRATE AND DISPLAY PANEL

CROSS REFERENCE TO RELATED APPLICATIONS

This application claims the priority of Chinese Patent Application No. 201710702249.0 filed on Aug. 16, 2017, titled "Scan Driver Circuit, Array Substrate and Display Panel", the disclosure of which is incorporated herein by reference in its entirety.

BACKGROUND OF THE INVENTION

1. Field of the Invention

The present invention relates to the field of display devices, and more particularly to the field of image-displaying scan driving of displays.

2. The Related Arts

To improve displaying performance of displays, regardless whether they are large-sized display screens for outdoor uses or small-sized display screens for consumer electronics, more and more people place their attention on designs for slim frames of display devices. Slim-frame display devices could effectively reduce a non-display area of a joint screen and effectively increase screen ratio to thereby increase overall displaying performance. Thus, frame slimming is now an urgent issue to be resolved in the field of display devices.

SUMMARY OF THE INVENTION

To resolve the issue of frame slimming, the present invention provides a scan driver circuit that occupies a reduced amount of area.

In addition, the present invention also provides an array substrate and a display panel that include the scan driver circuit.

A scan driver circuit comprises a pull-up unit and a bootstrap unit arranged on a surface of a base. The pull-up unit comprises a pull-up thin-film transistor that outputs a scan drive signal. The bootstrap unit comprises a bootstrap capacitor electrically connected with the pull-up thin-film transistor to maintain stability of the scan drive signal. The pull-up thin-film transistor comprises a gate electrode, a first insulation layer, and a source electrode and a drain electrode that are stacked, in sequence, from the surface of the base. The bootstrap capacitor comprises a first conductive electrode and a second conductive electrode. The first conductive electrode and the source electrode are arranged on a common layer and are electrically connected with each other. A second insulation layer is arranged between the second conductive electrode and the first conductive electrode. The second conductive electrode is electrically connected, through the first via, to the gate electrode. The first via extending through the second insulation layer and the first insulation layer.

An array substrate comprises a display zone and a non-display zone. The display zone comprises multiple scan lines and multiple data lines, wherein the scan lines extending in a first direction and arranged at intervals of a predetermined distance in a second direction and mutually isolated from each other and the data lines extend in the second direction and arranged at intervals of a predetermined distance in the first direction and mutually isolated from each other. The multiple scan lines and the multiple data lines have intersections therebetween at which pixel units are formed. The non-display zone comprises the above-described scan driver circuit arranged therein. The scan driver circuit is electrically connected with the scan lines for supplying scan drive signals to the pixel units. The first direction, the second direction, and a third direction are mutually perpendicular.

A display panel comprises an opposite substrate and the above-described array substrate that are arranged opposite to each other. A display medium is interposed between the opposite substrate and the array substrate.

Compared to the prior art, the first conductive electrode and the second conductive electrode collectively form a bootstrap capacitor structure that involves the planarization layer as an insulation medium. Since the planarization layer has a relatively small thickness, the distance between the two electrodes of bootstrap capacitor can be reduced and accordingly, the size of the bootstrap capacitor in a first direction can be reduced, while the first direction is a width direction of an array substrate so that the size of a non-display zone of the array substrate in the first direction can be effectively reduced to achieve the purposes of frame slimming.

BRIEF DESCRIPTION OF THE DRAWINGS

To more clearly explain the technical solution of the present invention, a brief description of the drawings that are necessary for embodiments of the present invention is given below. It is obvious that the drawings that will be described below show only some embodiments of the present invention. For those having ordinary skills of the art, other drawings may be available from these attached drawings without the expense of creative effort and endeavor.

DETAILED DESCRIPTION OF THE PREFERRED EMBODIMENTS

A clear and complete description will be given below to technical solutions provided by embodiments of the present invention with reference to the attached drawings of the embodiments of the present invention. However, the embodiments described are only some, but not all, of the embodiments of the present invention. Other embodiments that are available to those having ordinary skills of the art based on the embodiment of the present invention, without the expense of creative effort and endeavor, are considered belonging to the scope of protection of the present invention.

Figure 1:
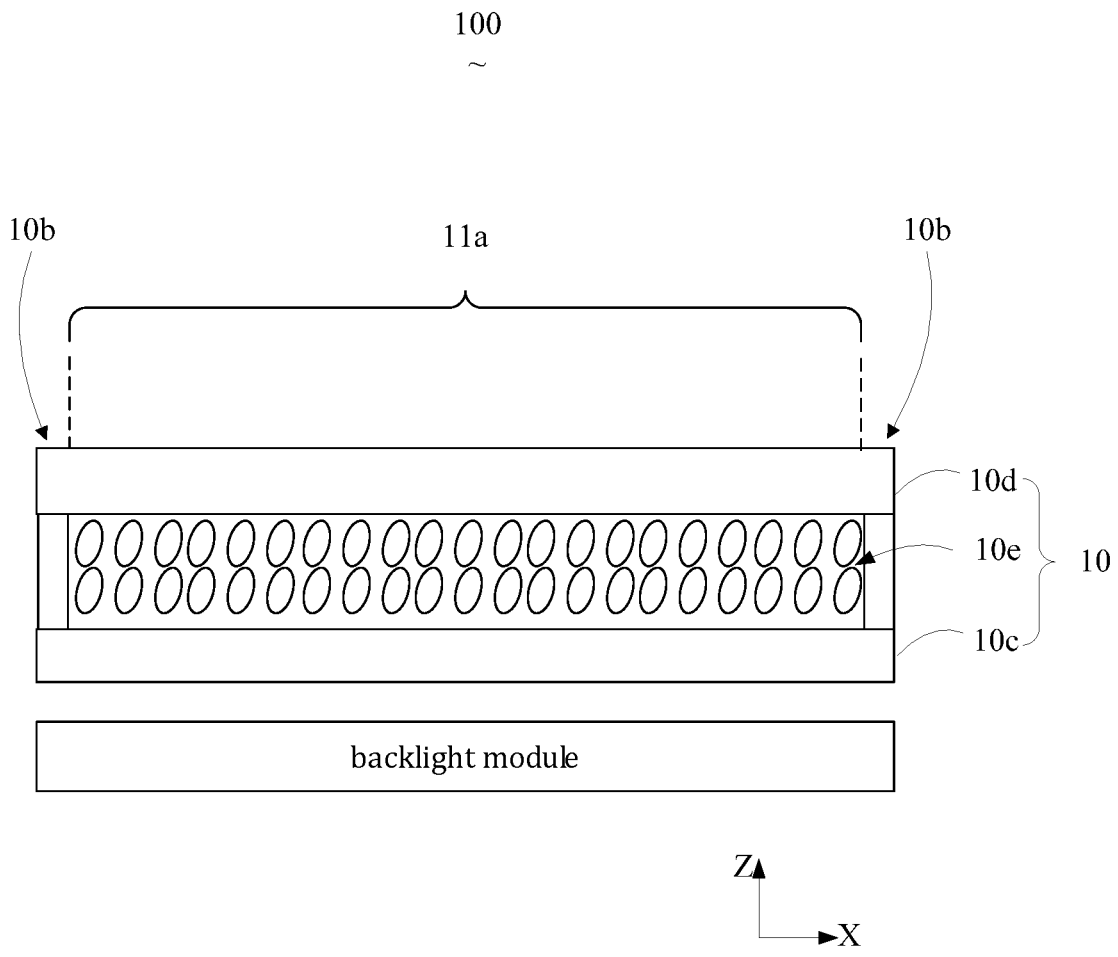
FIG. 1 is a schematic view illustrating a display device according to an embodiment of the present invention.

FIG. 1 is a schematic view illustrating a display device according to an embodiment of the present invention. As shown in FIG. 1, the display device 100 comprises a display panel 10 and a backlight module that serves as an optical module, wherein the display panel 10 comprises an image display zone 10*a* and a non-display zone 10*b*. The display zone 10*a* functions to display an image. The non-display zone 10*b* is circumferentially arranged around a periphery of the display zone 10*a* and is not a light exit area and does not function to display images. The display panel 10 further comprises an array substrate 10*c* and an opposite substrate 10*d*, and a liquid crystal layer 10*e* interposed between the array substrate 10*c* and the opposite substrate 10*d*. In the instant embodiment, the display panel 10 of the display device 100 uses a liquid crystal material as a display medium. It is certain that in other alternative embodiments of the present invention, the display panel 10 of the display device 100 can be made of an organic electroluminescence diode (OLED) material as a display module, but not limited thereto. To simplify the description of the disclosure, a three-dimensional rectangular coordinate system is first provide defined by a first direction X, a second direction Y, and a third direction Z that are mutually perpendicular to each other, wherein the third direction Z is in a direction of thickness of the display device 100.

Figure 2:
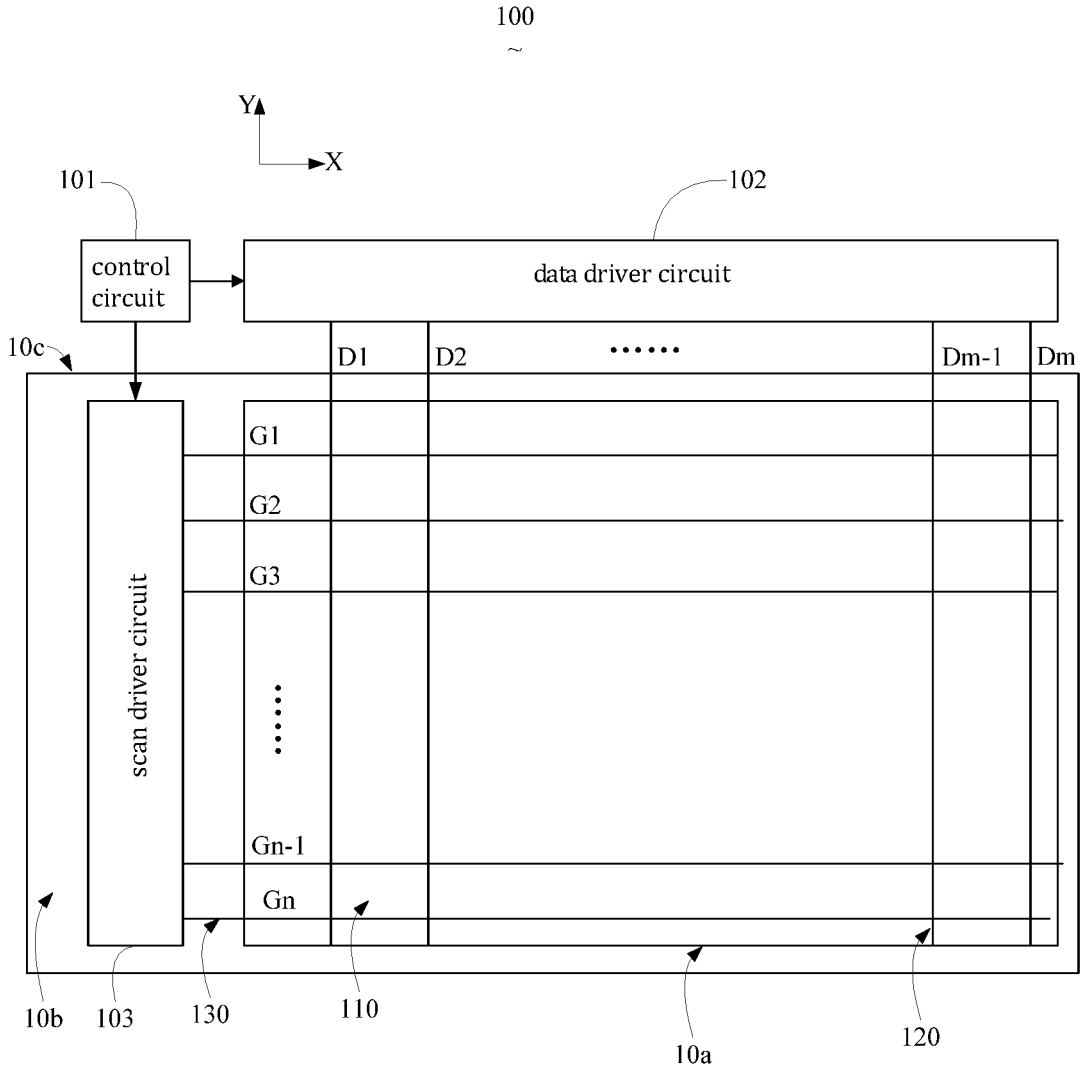
FIG. 2 is a schematic view illustrating a planar structure of an array substrate of a display panel shown in FIG. 1.

Referring to FIG. 2, which is a schematic view illustrating a planar structure of the array substrate 10*c* of the display panel 1*o* shown in FIG. 1, as shown in FIG. 2, the array substrate 10*c* has a first zone (not labeled) that corresponds to the image display zone 10*a* and comprises a plurality of m*n pixel units 110 arranged in an array, m data lines 120, and n scan lines 130, where m and n are both natural numbers greater than 1.

The multiple data lines 120 are arranged at internals of first predetermined distance in the first direction Y to be isolated from and parallel with each other. The multiple scan lines 130 are also arranged at internals of second predetermined distance in the second direction X to be isolated from and parallel with each other and the multiple scan lines 130 and the multiple data lines 120 are isolated from each other. The first direction X and the second direction Y are mutually perpendicular to each other. For easy explanation, the m data lines 120 are respectively referred to as D1, D2, . . . , Dm−1, and Dm; and the n scan lines 130 are respectively G1, G2, . . . , Gn−1, and Gn. A plurality of pixel units 110 are arranged in a matrix defined by the multiple data lines 120 and the multiple scan lines 130 and are respectively and electrically connected with the data lines 120 and the scan lines 130 corresponding thereto.

Corresponding to the non-display zone 10*b* of the display panel 10, the display device 100 (FIG. 1) further comprises, arranged in the non-display zone 10*b*, a control circuit 101, data driver circuit 102, and a scan driver circuit 103, which are arranged in a second zone (not labeled) of the array substrate 11*c*, for driving the plurality of pixel units 110 that are arranged in an array to display an image. The data driver circuit 102 is electrically connected with the multiple data lines 120 for transmission of image data to be displayed, in the form of digital voltages, through the multiple data lines 120 to the plurality of pixel units 110. The scan driver circuit 103 is electrically connected with the multiple scan lines 130 for output of scan signals through the multiple scan lines 130 to control the time when the pixel units 110 receives image data to display an image. The control circuit 101 is electrically connected with both the data driver circuit 102 and the scan driver circuit 103 to control operation timing of the data driver circuit 102 and the scan driver circuit 103, namely supplying corresponding timing control signals to the data driver circuit 102 and the scan driver circuit 103.

In the instant embodiment, the scan driver circuit 103 is directly arranged on the non-display zone 10*b* of the display panel 11, while the control circuit 101 and the data driver circuit 102 are arranged on a circuit carrying board that is independent of the array substrate 11*c*. In the instant embodiment, electronic components of the scan driver circuit 103 and the pixel units 110 of the display panel 11 are collectively formed, in the same manufacturing process, on the display panel 11, namely the so-call gate-on-array (GOA) technology. Further, the pixel units 110 comprises, corresponding thereto, thin-film transistors and pixel electrodes, which could be manufactured with a low temperature poly-silicon (LTPS) process. Of course, the scan driver circuit 103 may also be manufactured with the LTPS.

It is appreciated that the display panel 10 may further comprise other assistant circuits to collaboratively carry out image displaying, such as a graphics processing unit (GPU) and a power supply circuit. Additional description will be omitted in the instant embodiment.

Figure 3:
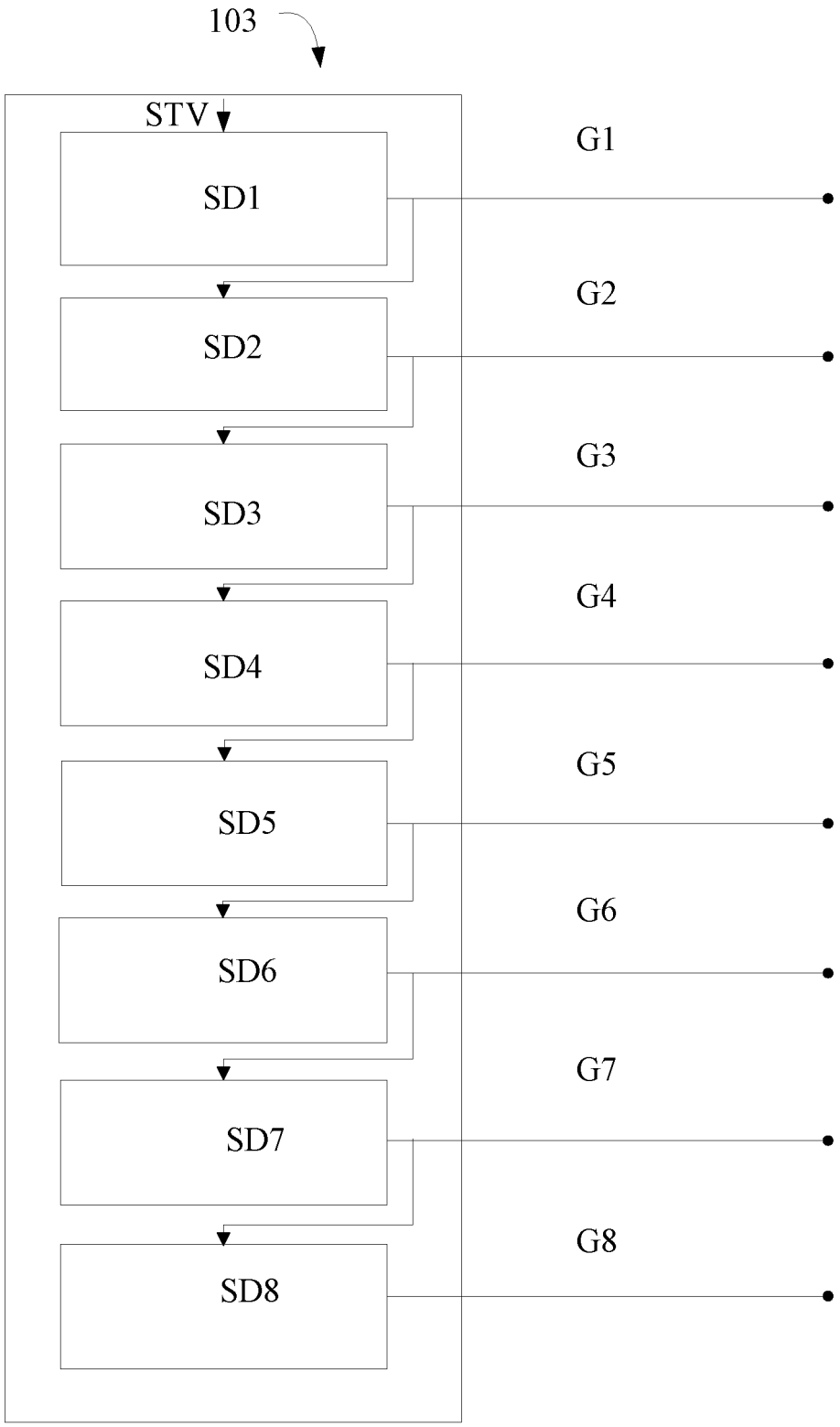
FIG. 3 is a schematic view illustrating connection between a scan drive circuit and scan lines of the display panel shown in FIG. 2.

Referring to FIG. 3, a schematic view is provided to illustrate connection between the scan drive circuit 103 and scan lines 130 of the display panel 10 shown in FIG. 2.

The scan driver circuit 103 comprises n scan drive units SD1-SDn that are connected in cascade. The n scan drive units SD1-Dn are respectively and electrically connected with the n scan lines 130 and output, in sequence, n scan signals Sc to the scan lines 130 corresponding thereto in order to control the pixel units 110 electrically therewith in a condition of receiving data voltages. For easy manufacturing, it is often to group multiple ones of the scan drive units SD as a group. For easy explanation, in the instant embodiment, as shown in FIG. 3, every eight scan drive units SD are set as a group. As shown in FIG. 3, the scan drive units SD1-SD8 are set as one group of scan drive units and are respectively corresponding to scan lines G1-G8 to respectively supply scan drive signals for G1-G8. Each of the scan drive units SD is arranged to have a lengthwise direction extending in the first direction X and a width direction extending in the second direction Y.

Figure 4:
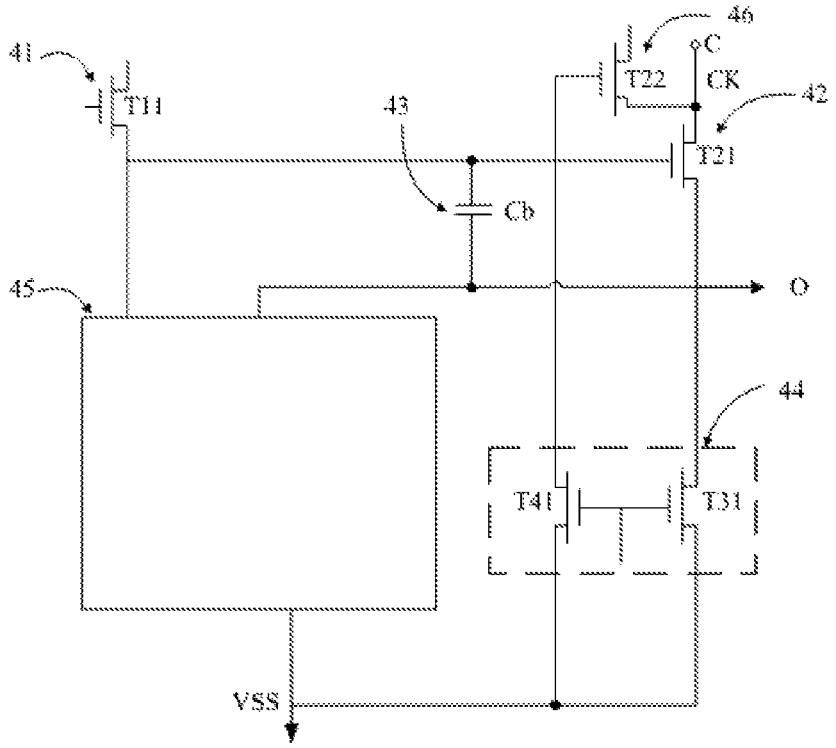
FIG. 4 is a circuit diagram of one scan drive unit illustrated in FIG. 3.

Referring to FIG. 4, a circuit diagram of one of the scan drive units SDi illustrated in FIG. 3 is provided.

Each of the scan drive units SDi comprises a pull-up control unit 41, a pull-up unit 42, a bootstrap unit 43, a pull-down unit 44, a pull-down holding unit 45, and a down transmission unit 46.

The pull-up control unit 41 is arranged to receive a drive signal STV and is controlled by the drive signal STV to supply a control signal to the pull-up unit 42. The pull-up unit 42 is controlled by the control signal to supply, according to a clock signal CK, a scan drive signal. In the instant embodiment, the pull-up control unit 41 is realized with a thin-film transistor T11, and the pull-up unit 42 comprises a pull-up thin-film transistor T21, wherein a gate electrode G of the pull-up thin-film transistor T21 is electrically connected with the pull-up control unit 41 to receive the control signal; a source electrode S of the pull-up thin-film transistor T21 is electrically connected with a scan output terminal O to output the scan drive signal; and a drain electrode D of the pull-up thin-film transistor T21 is electrically connected with a clock signal terminal C to receive the clock signal CK. The bootstrap unit 43 is constructed of a bootstrap capacitor Cb and is electrically connected between the gate electrode G and the source electrode S to maintain a waveform of the scan output signal. The bootstrap capacitor Cb has a first capacitance value.

The pull-down unit 44 is constructed of and realized with two thin-film transistors T31, T41 that are arranged in a mirror connection configuration and are respectively and electrically connected with the pull-up unit 42. The pull-down holding unit 45 is electrically connected with the pull-up control unit 41 and the scan output terminal O to maintain the scan output terminal O such that the scan output terminal O is controlled at a non-scan-drive-signal-output condition in a non-scan period so as to ensure the scan output terminal O of correct signal output. The down transmission unit 46 is electrically connected between the pull-up control unit and the clock signal terminal C to achieve a control of transmission of the scan drive signal to a next scan drive unit SDi+1 that is adjacent to the scan drive unit SDi after the scan output terminal O completes output of the scan drive signal so as to drive the scan drive unit SDi+1 to output a scan drive signal in a next scan period.

Figure 5:
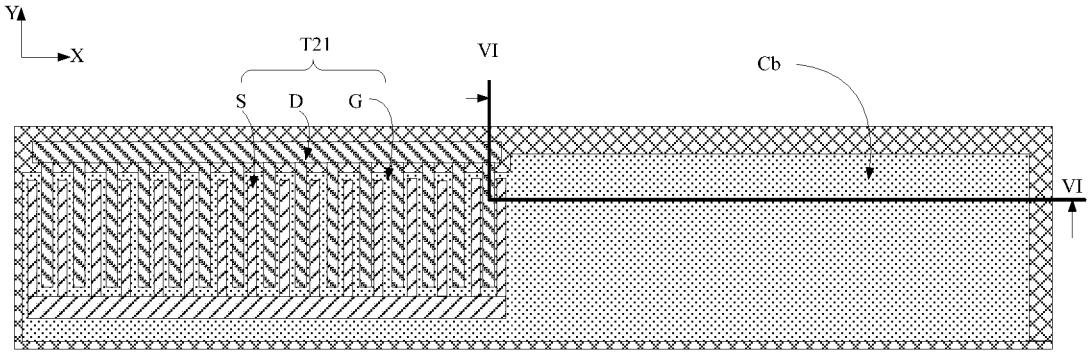
FIG. 5 is a schematic view illustrating a planar structure of a pull-up thin-film transistor and a bootstrap capacitor of FIG. 4 arranged on an array substrate.

Referring to FIG. 5, a schematic view is provided to illustrate a planar structure of the pull-up thin-film transistor and the bootstrap capacitor of FIG. 4 arranged on the array substrate 10*c*.

As shown in FIG. 5, the pull-up thin-film transistor T21 and the bootstrap capacitor Cb are arranged parallel to each other, as spaced in the first direction X. The bootstrap capacitor Cb has a first size L1 in the first direction X. The gate electrode G of the pull-up thin-film transistor T21 and one of electrodes of the bootstrap capacitor Cb are set on the same layer in the first direction X; the source electrode S of the pull-up thin-film transistor T21 and another one of the electrodes of the bootstrap capacitor Cb are set on the same layer in the first direction X.

Figure 6:
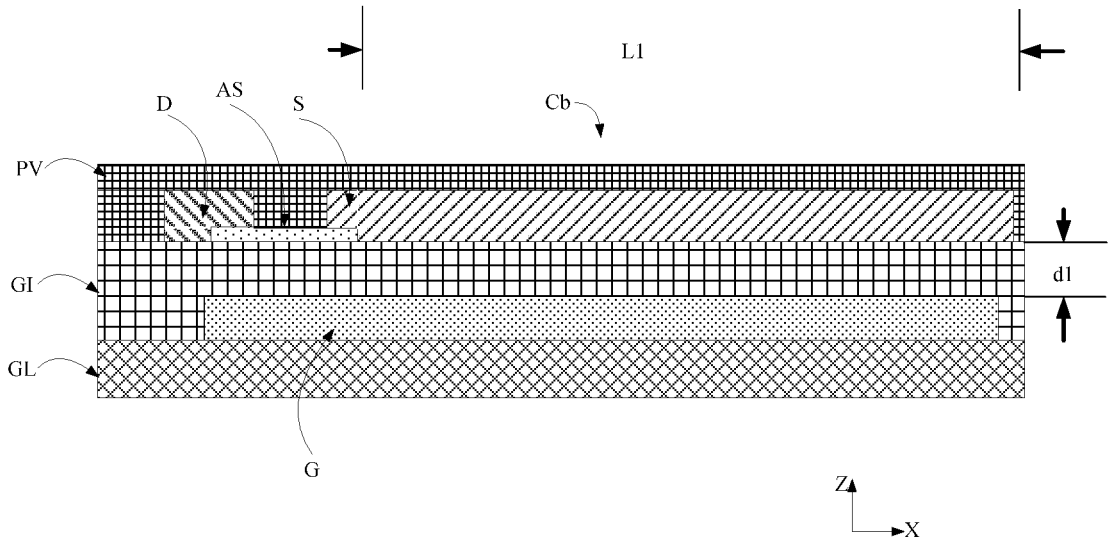
FIG. 6 is a cross-sectional view illustrating a structure, in a schematic form, taken along line VI-VI of FIG. 5.

Further, referring to FIG. 6, which is a cross-sectional view illustrating a structure, in a schematic form, taken along line VI-VI of FIG. 5, as shown in FIG. 6, the pull-up thin-film transistor 21 and the bootstrap capacitor Cb are stacked, in the third direction Z, on a surface of a base GL of the array substrate 10*c*. Specifically, for the pull-up thin-film transistor 21, starting from the surface of the base GL, the gate electrode G, a gate insulation layer GI, a semiconductor layer As, the source electrode S and the drain electrode D, and the planarization layer PV are arranged in sequence, wherein the source electrode S and the drain electrode D that are arranged on the same layer in the first direction X and spaced from each other by a predetermined distance are set on surfaces of the semiconductor layer As and the gate insulation layer GI corresponding thereto. For the bootstrap capacitor Cb, one electrode P1 is formed of an extension of the gate electrode Gin the first direction X and another electrode P2 is formed of an extension of the source electrode S on the surface of the gate insulation layer GI in the first direction X. The gate insulation layer GI also works as a dielectric material between the electrodes of the bootstrap capacitor Cb.

Studies reveal that the capacitance of the bootstrap capacitor Cb is a key factor that ensures correct output of the scan drive signal. This is because for a greater value of the capacitance of the bootstrap capacitor Cb, in combination with the performance of a capacitor being not changeable abruptly, the bootstrap capacitor Cb is more capable of ensuring the waveform of the scan drive signal does not interfere with an external signal and deterioration so as to keep the waveform of the scan drive signal close to an ideal one. However, according to the capacitance formula, a first capacitance of the bootstrap capacitor Cb is $C1=A\varepsilon/d$, wherein c is a dielectric constant between the two electrodes; A is a surface area of the electrode plates, which is w1*L1; and d is a distance between the electrode plates, which is a first size d1 of the gate insulation layer GI in the third direction Z between the source electrode S and the gate electrode D. To enlarge the capacitance of the bootstrap capacitor Cb as much as possible, the surface area A of the two electrode plates of the bootstrap capacitor Cb must be made as large as possible, and the distance d between the two electrode plates as small as possible. Further, to ensure stability of the manufacturing process and to make the operability of the pull-up thin-film transistor T21 more stable and more reliable, the insulation layer between the source electrode and the gate electrode of the pull-up thin-film transistor T21 must be enlarged as much as possible. As such, in order to make the capacitance the bootstrap capacitor Cb as large as possible, it is necessary to formed the two electrode plates of the bootstrap capacitor Cb with an much more enlarged surface area A and consequently, with the dimensional size of the capacitor in the second direction Y on the array substrate 10*c* being fixed, the dimensional size of the bootstrap capacitor Cb is the first direction X must be increased and thus, the sizes of the array substrate 10*c* and the non-display zone of the display panel 10 in the first direction X cannot be reduced and it is not possible to suit the need for frame slimming.

Figure 7:
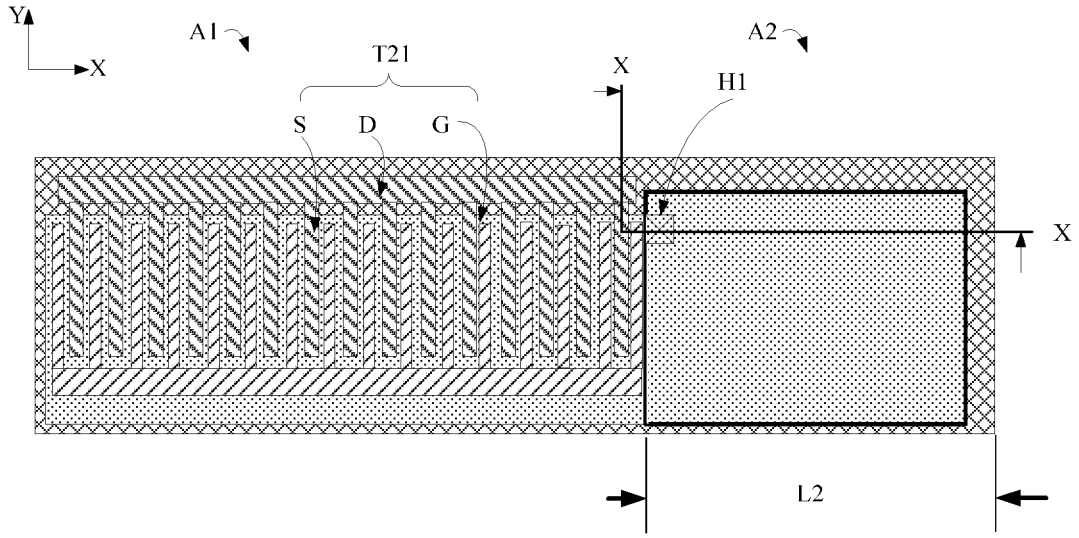
FIG. 7 is a schematic view illustrating a planar structure of a pull-up thin-film transistor and a bootstrap capacitor, as illustrated in FIG. 4, arranged on an array substrate 10*c* according to a first embodiment of the present invention.
Figure 8:
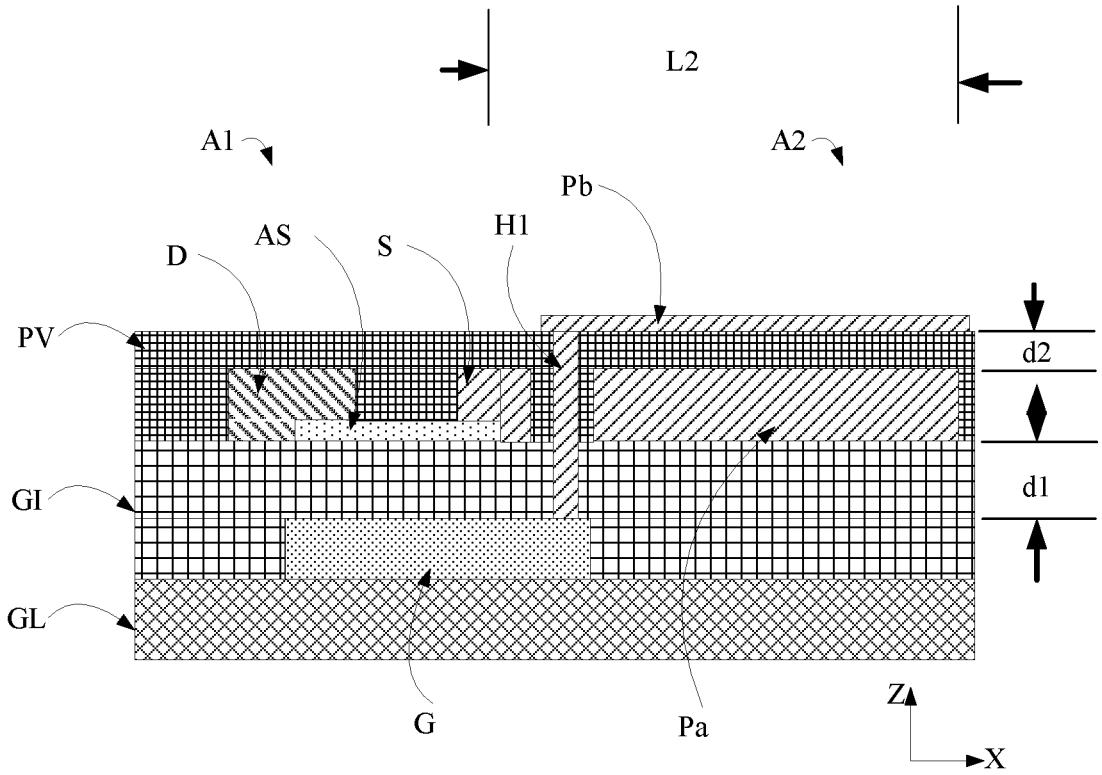
FIG. 8 is a cross-sectional view illustrating a structure, in a schematic form, taken along line X-X of FIG. 7.

Referring to FIGS. 7 and 8, a schematic view is provided to illustrate a planar structure of the pull-up thin-film transistor and the bootstrap capacitor, as illustrated in FIG. 4, arranged on the array substrate 10*c* according to a first embodiment of the present invention, while FIG. 8 provides a cross-sectional view illustrating a structure, in a schematic form, taken along line X-X of FIG. 7.

As shown in FIG. 7, the pull-up thin-film transistor T21 and the bootstrap capacitor Cb are arranged parallel in the first direction X. The array substrate 10*c* is defined with a first zone A1 and a second zone A2 respectively corresponding to the pull-up thin-film transistor T21 and the bootstrap capacitor Cb. The first zone A1 and the second zone A2 extend in the first direction X and the second direction Y and the first zone A1 and the second zone A2 cast projections on the base GL in a direction perpendicular to the base GL, which are generally not overlapping each other.

Corresponding to the first zone A1, the pull-up thin-film transistor T21 is formed through layers stacking in sequence, in the third direction Z, from the surface of the base GL.

Corresponding to the second zone A2, the capacitor Cb is formed through layers stacking in sequence, in the third direction Z, from the surface of the base GL.

Specifically, referring to FIG. 8, corresponding to the first zone A1, starting from the surface of the base GL, the gate electrode G and the gate insulation layer GI of the pull-up thin-film transistor T21 are such that the gate electrode G, the gate insulation layer GI that serves as a first insulation layer, the semiconductor layer As, the source electrode S and the drain electrode D, and the planarization layer PV that serves as a second insulation layer, are arranged in sequence, and the source electrode S and the drain electrode D are arranged on the same layer, as being spaced from each other by a predetermined distance, on the surface of the semiconductor layer As corresponding thereto. The gate insulation layer GI has a first size d1 in the third direction Z.

Corresponding to the second zone A2, starling from the surface of the base GL, the gate insulation layer GI, the first conductive electrode Pa, the planarization layer PV, and the second conductive electrode Pb are arranged in sequence. The first conductive electrode Pa and the source electrode S are arranged on the same layer, namely both being arranged on the surface of the gate insulation layer GI. The planarization layer PV between the second conductive electrode Pb and the first conductive electrode Pa has a second size d2 in the third direction Z, where d2=½d1. The second conductive electrode Pb is electrically connected, through the first via H1, to the gate electrode G. At a location between the source electrode S and the first conductive electrode Pa, the via H1 extends, from a surface of the planarization layer PV, through the planarization layer PV and the gate insulation layer GI to reach the surface of the gate electrode G.

Further, projections of the second conductive electrode Pb and the first conductive electrode Pa cast in the third direction Z on the base GL are such that one overlaps and completely covers the other or they are completely identical to each other. The projection of the second conductive electrode Pb on the base GL has a surface area that is greater than a surface area of the projection of the first conductive electrode Pa cast on the base GL. Further, projections of the second conductive electrode Pb and the source and drain electrode S, D on the base GL in the third direction Z do not overlap. The projections of the first conductive electrode Pa and the gate electrode G on the base GL in the first direction X do not overlap, meaning, in the instant embodiment, the gate electrode G is arranged only inside the first zone A and does not extend into the second zone A2.

In the instant embodiment, a material that makes the first conductive electrode Pa and a material that makes the source electrode S are identical, both being formed in the same manufacturing process to electrically connect with each other. A material of the second conductive electrode Pb can be indium tin oxide (ITO). The gate insulation layer GI and the planarization layer PV are both formed of insulation materials.

The capacitor formed of the first conductive electrode Pa and the second conductive electrode Pb has a first capacitance value C1, and it is known according to the formula of capacitance that C1=A1ε/d2. Since A2=w1*L2 and d2=½d1, to ensure the first capacitance value C1 is kept fixed, with the size of each drive unit SDi in the second direction Y being fixed so that the bootstrap capacitor Cb so constructed has a size w1 in the second direction Y is kept as a constant size, the bootstrap capacitor Cb of each drive unit SDi has a size L2 in the first direction X being ½ of L1. Since the first direction X is the width direction of the array substrate 10*c*, the size of the non-display zone of the array substrate 10*c* in the first direction X can be reduced to achieve the purpose of frame slimming.

It is appreciated that although in the instant embodiment, d2=½d1, yet, alternatively, it only needs to ensure the second size d2 of the planarization layer PV is smaller than the first size d1 of the gate insulation layer GI to ensure reduction of the size of the bootstrap capacitor Cb in the first direction X to thereby achieve the purposes of frame slimming.

Figure 9:
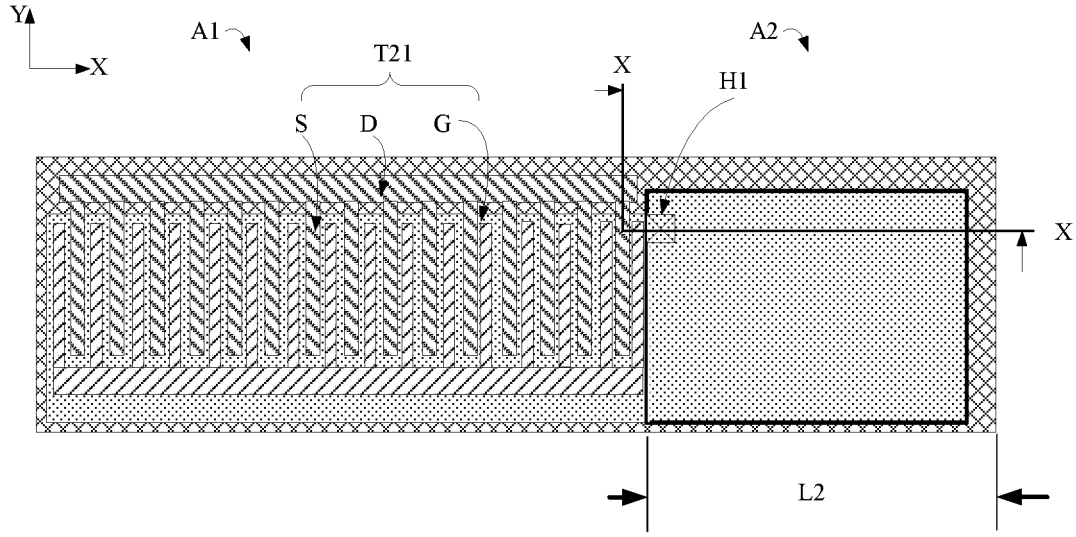
FIG. 9 is a schematic view illustrating a planar structure of a pull-up thin-film transistor and a bootstrap capacitor, as illustrated in FIG. 4, arranged on an array substrate 10*c* according to a second embodiment of the present invention.
Figure 10:
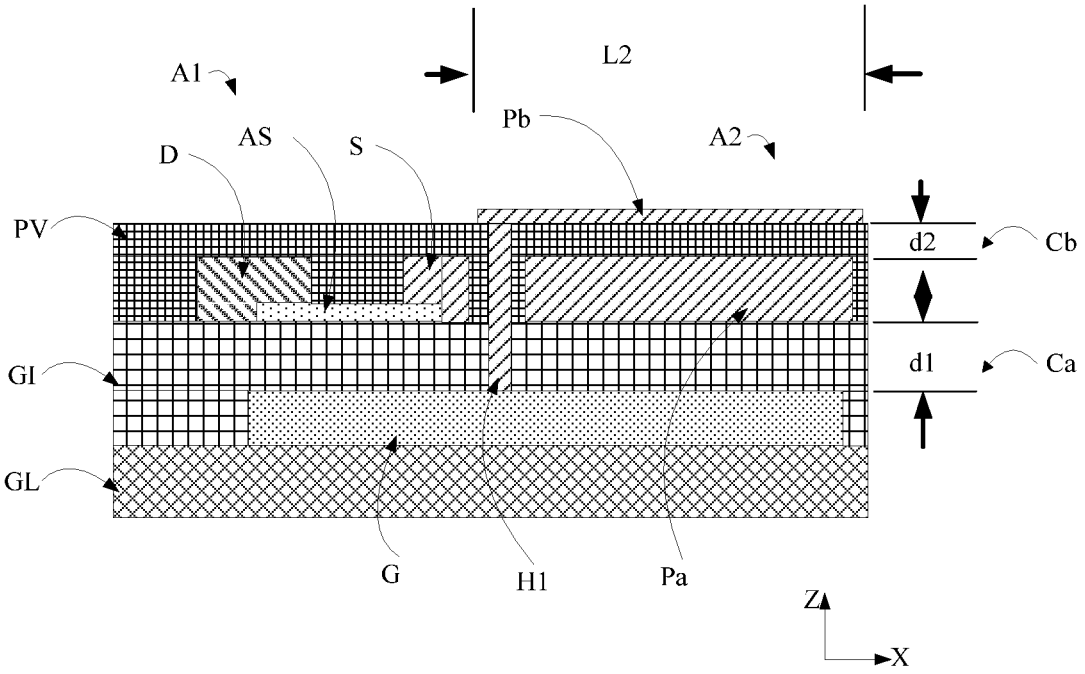
FIG. 10 is a cross-sectional view illustrating a structure, in a schematic form, taken along line X-X of FIG. 9.

Referring collectively to FIGS. 9 and 10, FIG. 9 is a schematic view illustrating a planar structure of the pull-up thin-film transistor and the bootstrap capacitor, as illustrated in FIG. 4, arranged on the array substrate 10*c* according to a second embodiment of the present invention, and FIG. 10 is a cross-sectional view illustrating a structure, in a schematic form, taken along line X-X of FIG. 9.

In the instant embodiment, the pull-up thin-film transistor T21 and the bootstrap capacitor Cb have structures that are similar to those of the first embodiment and a difference resides in the structure of the gate electrode G. Specifically, the gate electrode G extends from the first zone A1 into the second zone A2, and the projections of the first conductive electrode Pa and the gate electrode G cast in the third direction Z onto the base GL overlap each other, and the projection of the gate electrode G cast in the third direction Z onto the base GL completely covers the projection of the first conductive electrode Pa cast in the third direction Z onto the base GL.

Under this condition, for the bootstrap capacitor Cb in the second zone A2, the first capacitor electrode Pa and the gate electrode G form a first sub-capacitor Ca in the third direction Z and the first sub-capacitor has a capacitance of ½C1; the second conductive electrode Pb and the first conductive electrode Pa form a second sub-capacitor Cb in the third direction Z and the first sub-capacitor and the second sub-capacitor are arranged in parallel in the third direction Z. The capacitance of the second sub-capacitor Cb is C1, as described in the first embodiment, and Ca+Cb=3/2C1. It is clear that in the instant embodiment, the size of the bootstrap capacitor Cb in the first direction X is reduced, while the capacitance is increased. In other words, the area of the non-display zone is reduced, but the driving performance of the scan drive signal is effectively assured.

Figure 11:
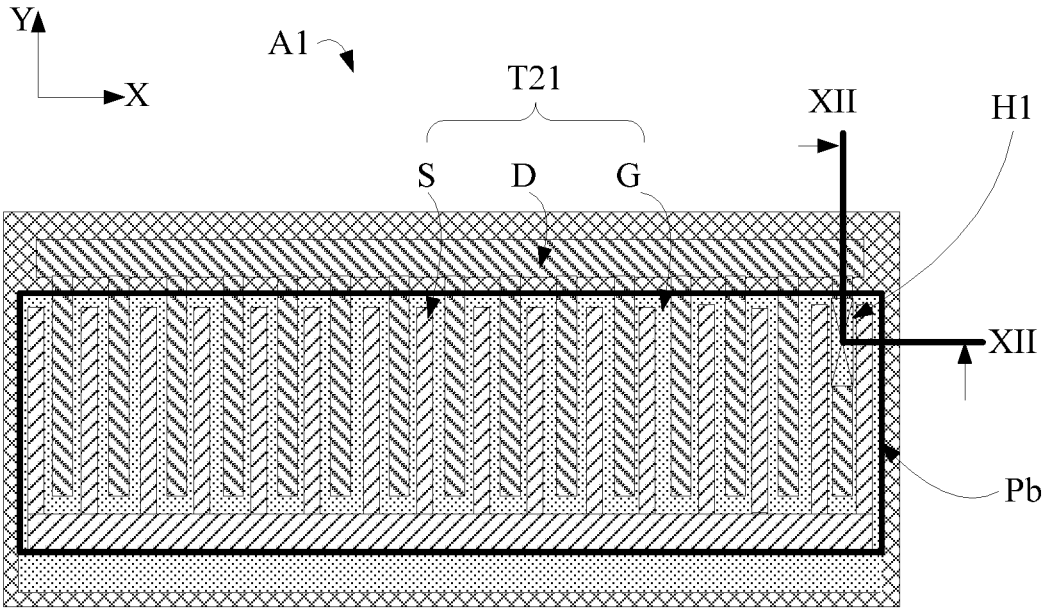
FIG. 11 is a schematic view illustrating a planar structure of a pull-up thin-film transistor and a bootstrap capacitor, as illustrated in FIG. 4, arranged on an array substrate 10*c* according to a third embodiment of the present invention.
Figure 12:
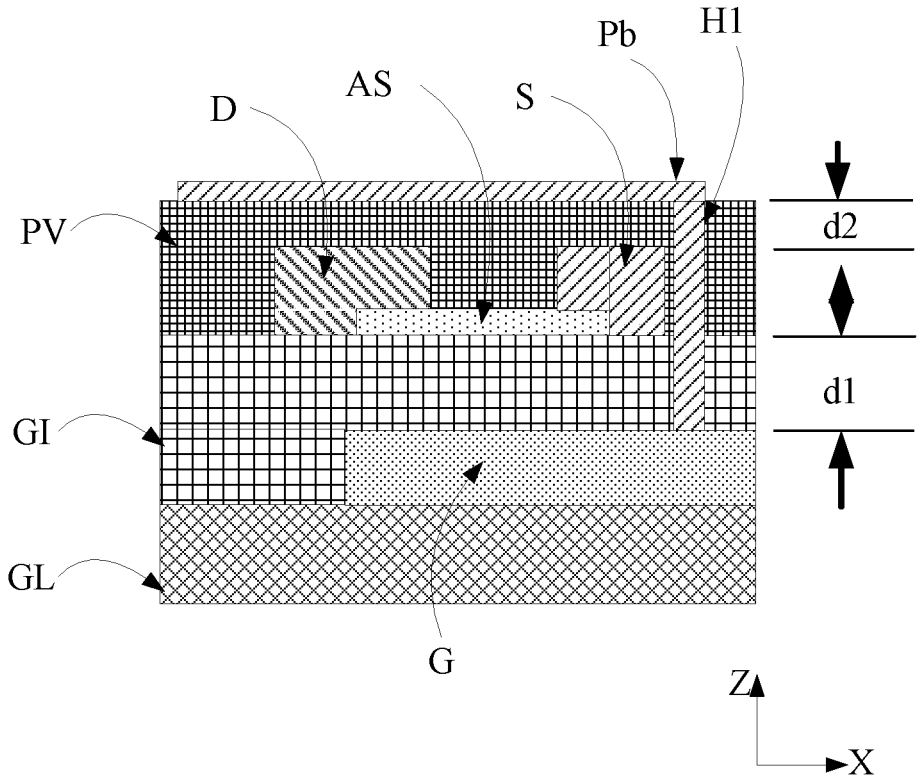
FIG. 12 is a cross-sectional view illustrating a structure, in a schematic form, taken along line XII-XII of FIG. 11.

Referring collectively to FIGS. 11 and 12, FIG. 11 is a schematic view illustrating a planar structure of the pull-up thin-film transistor and the bootstrap capacitor, as illustrated in FIG. 4, arranged on the array substrate 10*c* according to a third embodiment of the present invention, and FIG. 12 is a cross-sectional view illustrating a structure, in a schematic form, taken along line XII-XII of FIG. 11.

In the instant embodiment, the pull-up thin-film transistor T21 and the bootstrap capacitor Cb have structures that are similar to those of the first embodiment and a difference resides in that the pull-up thin-film transistor T21 and the bootstrap capacitor Cb overlap each other in the first zone A1 and the second zone A2 that is involved in the prior art, the first embodiment, and the second embodiment is omitted completely.

Specifically, the source electrode S also functions as the first conductive electrode Pa. The second conductive electrode Pb is set on the surface of the planarization layer PV at a location corresponding to the source electrode S and the drain electrode D. In other words, a projection of the second conductive electrode Pb cast in the third direction Z on the base GL covers projections of the source electrode S, the drain electrode G and the gate electrode G cast in the third direction on the base GL. The source electrode S and the second conductive electrode Pb form a capacitor structure that has the first capacitance value C1.

In the instant embodiment, the pull-up thin-film transistor T21 and the bootstrap capacitor Cb commonly use one area and in other words, compared to the array substrate 10*c* of FIG. 5, an area solely occupied by the bootstrap capacitor Cb is omitted and the size of the non-display zone of the array substrate 10*c* that the bootstrap capacitor Cb in the first direction can be more greatly reduced to make it easy to achieve the purpose of frame slimming of the array substrate.

Figure 13:
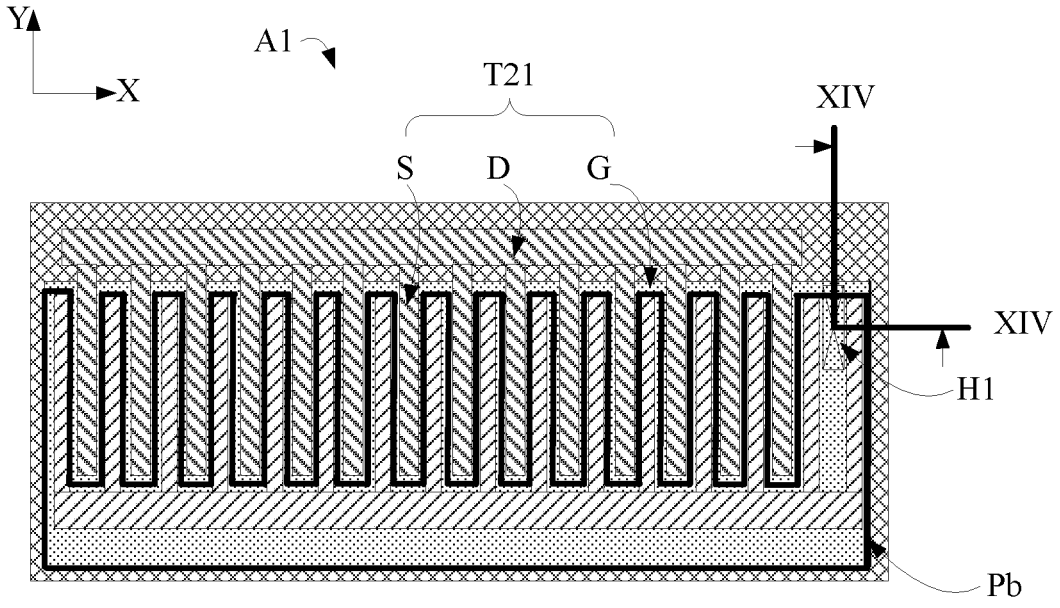
FIG. 13 is a schematic view illustrating a planar structure of a pull-up thin-film transistor and a bootstrap capacitor, as illustrated in FIG. 4, arranged on an array substrate 10*c* according to a fourth embodiment of the present invention.
Figure 14:
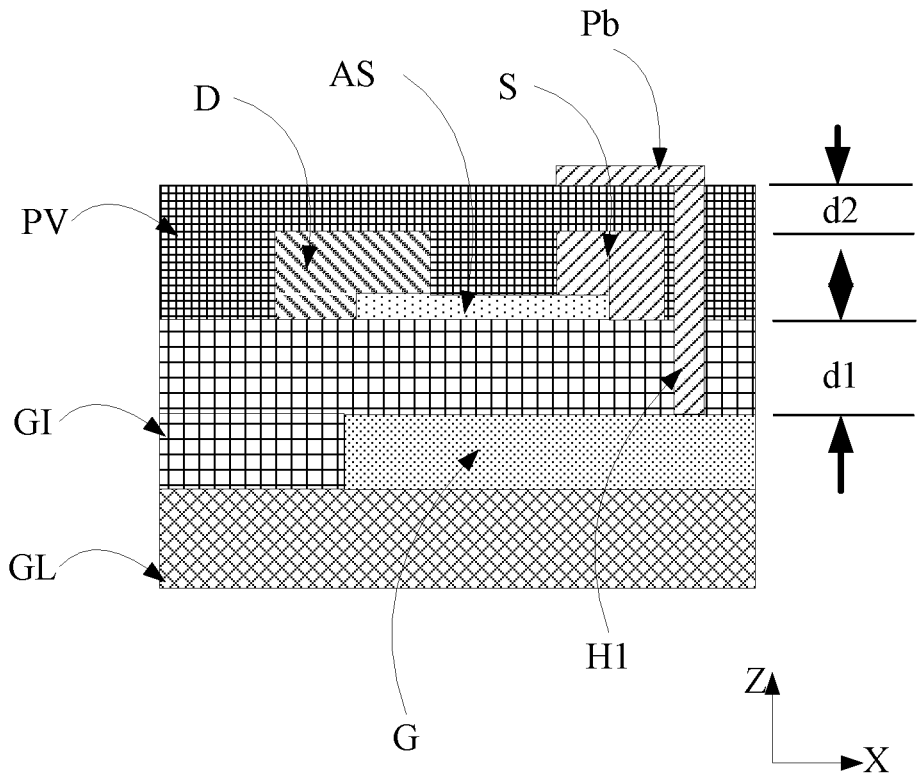
FIG. 14 is a cross-sectional view illustrating a structure, in a schematic form, taken along line XIV-XIV of FIG. 13.

Referring collectively to FIGS. 13 and 14, FIG. 13 is a schematic view illustrating a planar structure of the pull-up thin-film transistor and the bootstrap capacitor, as illustrated in FIG. 4, arranged on the array substrate 10*c* according to a fourth embodiment of the present invention, and FIG. 14 is a cross-sectional view illustrating a structure, in a schematic form, taken along line XIV-XIV of FIG. 13.

In the instant embodiment, the pull-up thin-film transistor T21 and the bootstrap capacitor Cb have structures that are similar to those of the third embodiment and a difference resides in the structure of the second conductive electrode Pb.

Specifically, the source electrode S also functions as the first conductive electrode Pa. The second conductive electrode Pb is set on the surface of the planarization layer PV at only a location that corresponds to the source electrode S and is not extended to a portion of the surface of the planarization layer PV that corresponds to the drain electrode D. In other words, projections of the second conductive electrode Pb, the source electrode S, and the gate electrode G cast in the third direction Z onto the base GL overlap each other, while projections of the second conductive electrode Pb and the drain electrode D cast in the third direction Z onto the base GL do not overlap. The source electrode S and the second conductive electrode Pb form a capacitor structure that has the first capacitance value C1.

In the instant embodiment, the second conductive electrode Pb does not cover the drain electrode D of the pull-up thin-film transistor T21 in the third direction so that the capacitance between the second conductive electrode Pb and the drain electrode D can be effectively reduced to avoid an increase of extra power consumption of the pull-up thin-film transistor T21 and thus enhancing operation stability of the pull-up thin-film transistor T21.

The embodiments described above are not construed as constraining to the scope of protection of the technical solutions so provided. Modifications, equivalent substitutes, and improvements within the spirit and principle of the above-described embodiment are considered belonging the scope of protection of those technical solutions.

What is claimed is:

1. A scan driver circuit, comprising a pull-up unit and a bootstrap unit arranged on a surface of a base, the pull-up unit comprising a pull-up thin-film transistor that outputs a scan drive signal, the bootstrap unit comprising a bootstrap capacitor electrically connected with the pull-up thin-film transistor to maintain stability of the scan drive signal, wherein:

the pull-up thin-film transistor comprises a gate electrode, a first insulation layer, and a source electrode and a drain electrode that are stacked, in sequence, from the surface of the base;

the bootstrap capacitor comprises a first conductive electrode and a second conductive electrode, wherein the first conductive electrode and the source electrode are arranged on a common layer and are electrically connected with each other; and a second insulation layer is arranged between the second conductive electrode and the first conductive electrode, the second conductive electrode being electrically connected to the gate electrode through the first via, the first via extending through the second insulation layer and the first insulation layer;

wherein the source electrode and the drain electrode are arranged to separate from each other by a predetermined distance in a first direction, the pull-up thin-film transistor and the bootstrap capacitor being stacked on the base in the third direction, the first direction and the third direction being mutually perpendicular to each other, the third direction being perpendicular to a plane on which the base is disposed, the first insulation layer between the gate electrode and the source electrode having a first size in the third direction, the second insulation layer between the first conductive electrode and the second conductive electrode having a second size in the third direction, the second size being smaller than the first size; and wherein the second size is ½ of the first size.

2. The scan driver circuit according to claim 1, wherein the second conductive electrode and the first conductive electrode have projections that are cast in the third direction onto the base, the projections being completely identical with each other or one of the projections having an area that is greater than an area of the other one of the projections, the second conductive electrode, the source electrode, and the drain electrode having projections that are cast in the third direction onto the base and do not overlap each other.

3. The scan driver circuit according to claim 2, wherein the first conductive electrode and the gate electrode have projections that are cast in the third direction onto the base and do not overlap each other.

4. The scan driver circuit according to claim 2, wherein the first conductive electrode and the gate electrode have projections that are cast in the third direction onto the base, and the projections being completely identical with each other or one of the projections having an area that is greater than an area of the other one of the projections.

5. The scan driver circuit according to claim 4, wherein the first conductive electrode and the gate electrode collectively form a first sub-capacitor in the third direction, and the second conductive electrode and the first conductive electrode form a second sub-capacitor in the third direction, the first sub-capacitor and the second sub-capacitor being arranged parallel in the third direction.

6. The scan driver circuit according to claim 1, wherein the source electrode also functions as the first conductive electrode, and the second conductive electrode has a projection that is cast in the third direction onto the base and covers projections of the source electrode, the drain electrode and the gate electrode cast in the third direction onto the base.

7. The scan driver circuit according to claim 1, wherein the source electrode also functions as the first conductive electrode, projections of the second conductive electrode, the source electrode and the gate electrode cast in the third direction onto the base are completely identical with each other, or one of the projections having an area that is greater than an area of another one of the projections, projections of the second conductive electrode and the drain electrode cast in the third direction onto the base do not overlap each other.

* * * * *